US008193741B2

(12) United States Patent
De Greef et al.

(10) Patent No.: US 8,193,741 B2
(45) Date of Patent: Jun. 5, 2012

(54) BOOSTING DRIVER CIRCUIT FOR LIGHT-EMITTING DIODES

(75) Inventors: Petrus Maria De Greef, Waalre (NL); Matheus Johannus Gerardus Lammers, Nederweert (NL)

(73) Assignee: NXP B.V. (NL)

( * ) Notice: Subject to any disclaimer, the term of this patent is extended or adjusted under 35 U.S.C. 154(b) by 414 days.

(21) Appl. No.: 12/647,242

(22) Filed: Dec. 24, 2009

(65) Prior Publication Data

US 2011/0156593 A1 Jun. 30, 2011

(51) Int. Cl.
*G05F 1/00* (2006.01)

(52) U.S. Cl. ..... 315/308; 315/209 R; 315/224; 315/309

(58) Field of Classification Search ..... 315/209 R, 315/210, 224, 225, 32, 71, 72, 74, 112, 113, 315/117, 118, 185 R, 186, 192, 193, 291, 315/294, 297, 299, 300, 301, 302, 307, 308, 315/309, 311, 312, 313, 360, 361, 362
See application file for complete search history.

(56) References Cited

U.S. PATENT DOCUMENTS

| | | | | |
|---|---|---|---|---|
| 7,868,557 | B2 * | 1/2011 | Deurenberg et al. | 315/149 |
| 8,115,418 | B2 * | 2/2012 | Haubmann | 315/307 |
| 2003/0057888 | A1 * | 3/2003 | Archenhold et al. | 315/291 |
| 2004/0164685 | A1 * | 8/2004 | Dygert | 315/224 |

* cited by examiner

*Primary Examiner* — Douglas W Owens
*Assistant Examiner* — Jianzi Chen
(74) *Attorney, Agent, or Firm* — Kramer & Amado P.C.

(57) ABSTRACT

Various embodiments relate to an light-emitting diode (LED) driver and related method that drives various LEDs in an LED string beyond their isolated nominal luminance. Individual LEDs in an LED string may be thermally dependent so that specific LEDs may operate at higher temperatures without degradation. This may include driving specific LEDs beyond isolated nominal luminance when associated LEDs dim below their isolated nominal luminance. Such operation allows the LED to receive higher amounts of current and therefore exhibit higher luminous intensity. A control circuit may monitor the forward voltage and temperature in a feedback loop to ensure that the LEDs in the string are operating below a defined maximum junction temperature. The control circuit may signal a processing unit to adjust adjacent circuits to compensate when the controlled LEDs cannot produce a requested luminance without operating beyond a maximum junction temperature.

20 Claims, 4 Drawing Sheets

BOOSTING DRIVER CIRCUIT FOR LIGHT-EMITTING DIODES

TECHNICAL FIELD

Embodiments disclosed herein relate generally to control circuit architecture for light-emitting diodes.

BACKGROUND

Two-dimensional (2D) dimming backlight technology is used for liquid crystal display television (LCD-TV) applications to, for example, improve the contrast and black levels of the display panel, as well as to reduce power consumption. The individual light-emitting diodes (LEDs) that make up an LED array in an LCD display may possess a wide spread of physical characteristics between the individual LEDs, due to, for example, variances in manufacturing within the LED array. The varying physical characteristics between individual LEDs may include forward voltage ($V_f$), luminance (i.e., brightness), power efficiency, and dominant wavelength. LED characteristics, such as color (i.e., white backlights vs. RGB colored lights) and luminance, may be adjusted relative to other individual LEDs in the LED array, or may be adjusted to adhere to a product specification.

During regular operation, the performance and operational lifetime of an individual LED may degrade when its junction temperature becomes overheated. An LED might become overheated due to the amount of power driven to it to, for example, increase the LED's luminance. Because luminance is directly proportional to power (and therefore, resistance) and temperature, a higher luminance output may cause the LED to overheat and degrade over time. As a result, many LED arrays are designed to avoid degradation, wherein individual LEDs are driven to only produce a nominal luminance, which may be defined as 100% luminance at maximum allowable temperature, during regular operation. Because of varying physical characteristics, an LED array may be designed for the worst-case scenario, guaranteeing the nominal luminance of the weakest LED, which may be defined as the individual LED in an LED array that has the smallest maximum temperature. A temperature sensor can be added to the system, which measures the temperature close to the LED and provides a signal to a feedback loop to adjust the current in order to stabilize the flux output as well as to prevent excessive LED temperatures. This allows for a higher luminance output and makes the system more efficient. The LED junction temperature can be measured more efficiently when using a forward voltage measurement and the known relationship between the forward voltage and temperature.

The control system of an LCD television may therefore drive an LED array towards a uniform luminance and color, while limiting the maximum luminance output of the entire LED array to only the nominal luminance of the weakest LED. During normal operation, a control circuit may manage the luminance of an LED array through the use of a pulse-width modulated (PWM) signal to control current delivered to the LEDs of the array. The PWM signal delivered by the control circuit may have a duty cycle with a range from 0-100% and may be directly proportional to the luminance, with a 100% duty cycle corresponding to a 100% luminance. A control circuit may then adjust the duty cycle of the PWM to limit the power delivered to the LED array.

While the control system for the LED array may guarantee operation in the worst-case scenario by guaranteeing against degradation for the weakest LED in the array, this design principle may also unnecessarily limit the possible luminance of other LEDs in the array, most of which are capable of outputting light at much higher luminance levels due to a higher maximum allowed temperature. Furthermore, the PWM control that regularly dims the array also dims the luminance of the more capable LEDs to much lower than their capacity. This may be an inefficient use of resources, as the arrangement of an LED array may severely limit a large number of more capable LEDs due to a limiting smallest maximum temperature. For example, the uniform design may limit both the brightness (maximum luminance) and contrast (range of luminance) when consuming a given amount of power. In view of the foregoing, it would be desirable to drive individual LEDs in an LED array beyond nominal luminance of the weakest LED.

SUMMARY

The present embodiments provide, among other features and benefits, a circuit to drive an LED string beyond nominal luminance of the weakest LED in the string, while restraining the junction temperatures of each individual LED within a desired specified temperature range. A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Various embodiments may relate to a circuit to deliver current from a direct-current voltage source to an LED string. The circuit may comprise a pulse width modulator controller for generating a pulse width modulated (PWM) drive signal having a duty cycle and driving the LED string with a regular current during an active period of the PWM drive signal, a forward voltage sense controller for driving a sense current, the sense current being driven into the LED string during an inactive period of the duty cycle of the PWM drive signal, and a forward voltage sense measuring controller for measuring a forward voltage in the LED string created by the sense current and for outputting the forward voltage. The circuit may also comprise a temperature controller for receiving the forward voltage from the forward voltage sense measuring controller and controlling the regular current, so that the LED string operates at a junction temperature below a maximum allowed operational junction temperature. The circuit may also comprise a current correction controller for receiving the forward voltage from the forward voltage sense measuring controller and controlling the regular current, wherein the flux of an LED in the LED string is stabilized by driving the LED with a constant power.

Various embodiments may also relate to a system for supplying power for a light-emitting diode (LED) string. The system may comprise a first circuit to deliver current from a direct-current voltage source to the LED string. The first circuit may comprise a pulse width modulator controller for generating a pulse width modulated (PWM) drive signal and driving the LED string with a regular current during an active period of the PWM driver signal, a forward voltage sense controller for driving a sense current, the sense current being driven into the LED string during an inactive period of the duty cycle of the PWM drive signal, and a forward voltage sense measuring controller for measuring a first forward voltage in the LED string created by the sense current and for outputting the first forward voltage. The first circuit may also comprise a temperature controller for: receiving the first forward voltage from the first forward voltage sense measuring controller and controlling the regular current, wherein the LED string operates below a maximum allowed operational junction temperature, and generating an alarm signal when at least either a junction temperature of at least one LED is above the maximum allowed operational temperature of the LED or the LED string cannot produce a first requested luminance. The first circuit may also comprise a current correction controller for receiving the first forward voltage from the forward voltage sense measuring controller and controlling the regular current, wherein the LED in the LED string is stabilized by driving the LED with a constant power. The system may also comprise a second circuit to deliver current from a second direct-current voltage source to a second LED array in response to the alarm signal received from the first circuit.

Various embodiments may also relate to a method for supplying power for a light-emitting diode (LED) string. The method may comprise generating a pulse width modulated (PWM) drive signal, supplying the LED string with a regular current in response to the PWM drive signal having a duty cycle, the regular current being supplied during an active period of the duty cycle of the PWM drive signal, supplying the LED string with a sense current during an inactive period of the duty cycle of the PWM drive signal. The method may also comprise measuring a forward voltage of the LED string during the inactive period of the duty cycle and modulating the regular current in response to the measured forward voltage, wherein the flux of an LED in the LED string is stabilized by driving the LED with a constant power and the LED string operates below a maximum allowed operational junction temperature.

It should be apparent that, in this manner, various exemplary embodiments enable an LED array to be driven past nominal luminance of the weakest LED, while the junction temperatures of each LED remains in a specified temperature range below the maximum temperature of each LED. More specifically, individual LEDs may also be driven past their individual nominal luminance due to dimming by LEDs that share a common lead-frame. Such a circuit may therefore deliver more luminance and possess a greater range of luminance without degradation.

BRIEF DESCRIPTION OF THE DRAWINGS

In order to facilitate better understanding of various exemplary embodiments, reference is made to the accompanying drawings, wherein.

DETAILED DESCRIPTION

Figure 1:
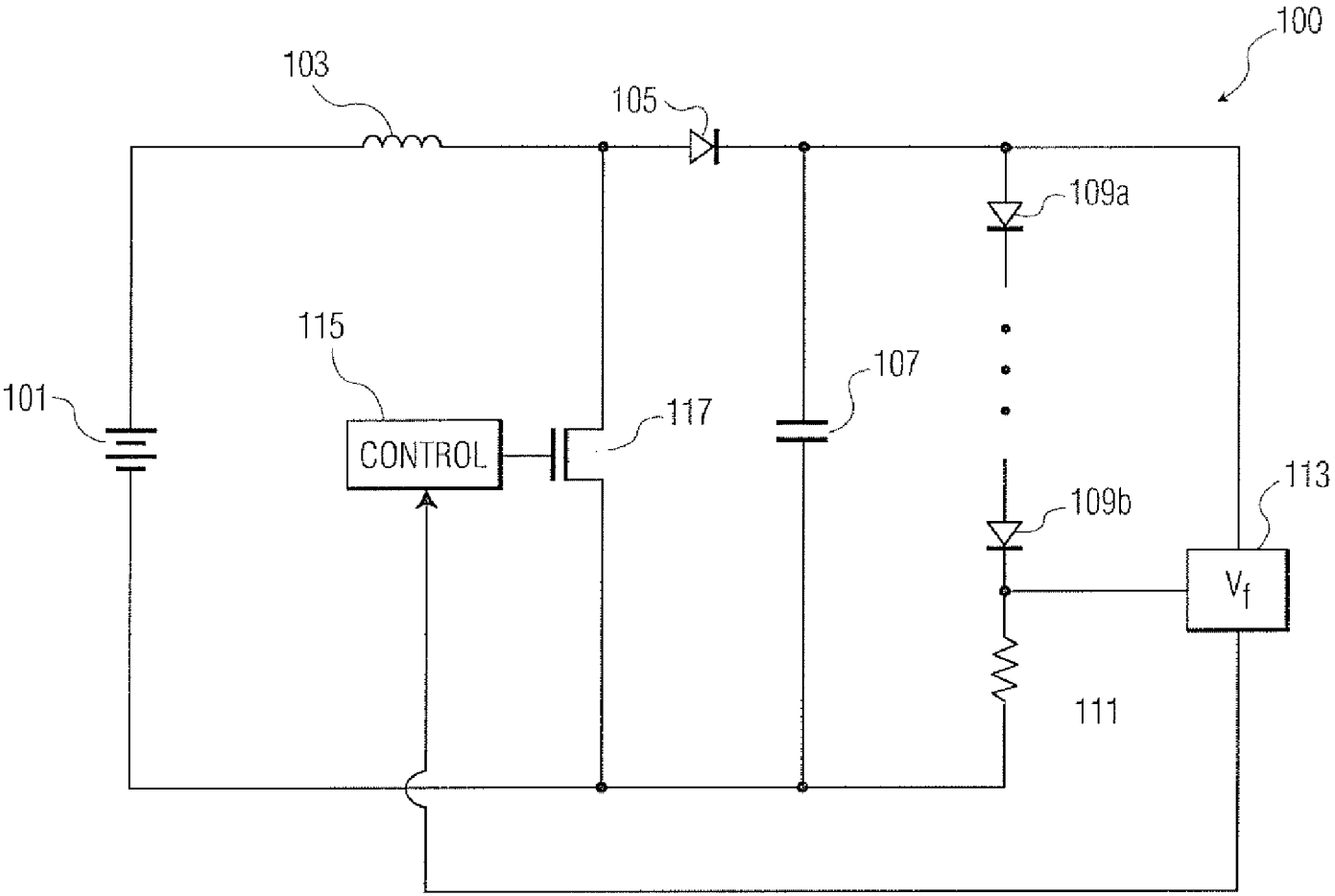
FIG. 1 is a functional block of an exemplary LED circuit.

Referring now to the drawings, in which like numerals refer to like components of steps, there are disclosed broad aspects of various exemplary embodiments.

FIG. 1 illustrates an exemplary light-emitting diode (LED) driver 100 having one example implementation of one control system according to one example embodiment. LED driver 100 may be a component of a display system that drives an LED array to produce an image through the control of a series of light-emitting diodes (LEDs). LED driver 100 may control an individual LED, an LED string, or all LEDs in an LED array. LED driver 100 may also be connected with at least one additional LED driver; the plurality of LED drivers may be controlled in concert by another control circuit to produce an image using the LED array.

LED driver 100 may connect to a DC power source 101 and may connect to an inductor 103, a diode 105, a capacitor 107, a light-emitting diode (LED) string 109*a-b*, a resistor 111, a forward voltage ($V_f$) control block 113, a switch control circuit 115, and a switch 117. During regular operation, power source 101 may deliver a forward current, which may charge inductor 103 when switch 117 is closed. When switch 117 opens, inductor 103 may deliver power to capacitor 107 and LED string 109*a-b* through diode 105. Resistor 111 may absorb any excess power delivered to LED string 109*a-b*. The resultant forward voltage of the LEDs that comprise one or more LED strings 109*a-b* may then be sensed by forward voltage control block 113. The resultant signal from forward voltage control block 113 may be received by switch control circuit 115 as an input. Switch control circuit 115 may receive the signal from forward voltage control block 113 and other inputs, such as, for example, a signal for a requested luminance level, and produce a signal that is sent to switch 117. The signal produced by switch control circuit 115 may have a duty cycle that turns the switch being off and on, with a longer duty cycle being directly proportional to a higher luminance. As will be described in greater detail in later sections, the luminous intensity may increase with higher currents and power levels, which may be regulated through control of switch 117. As will also be described in greater detail, switch control circuit 115 may use a number of inputs, including temperature, voltage, and luminance measurements, to control the amount of power driven to LED string 109*a-b*.

DC power source 101 may be a general-purpose direct current electrical power supply. DC power source 101 may also be a rectified raw DC voltage produced from an alternating-current (AC) power supply. A person of ordinary skill, in view of this disclosure, will recognize equivalent components to produce a DC voltage to drive an LED string 109*a-b*.

Continuing to refer to FIG. 1, a boost converter may comprise inductor 103, switch 117 controlled by switch control circuit 115, and diode 105. The boost converter may also include capacitor 107, LED string 109*a-b*, and resistor 111. In the illustrative embodiment, switch 117 may be a MOSFET. A person of ordinary skill will recognize switches alternative to a MOSFET and, based on the present disclosure would understand how to reconfigure LED driver 100 for their use. The boost converter may receive the voltage produced by DC power source 101 and produce an output voltage $V_{out}$, which may be delivered to LED string 109*a-b*. As understood by a person of ordinary skill in the or of LED drivers, in a boost converter, the voltage gain $V_{out}/V_{in}$ is generally proportional to the duty cycle switches comparable to switch 117 and, in LED drivers according to the inventive embodiments disclosed herein, is proportional to an average duty cycle of switch 117. The boost converter may therefore raise the received voltage $V_{in}$ to a higher voltage before delivering the output voltage $V_{out}$ to LED string 109*a-b*. The boost converter may be selected or configured to comply with voltage conventions such as, for example, high-power LCD display devices or other LED displays.

Switch control circuit 115 controls the functioning of the boost converter by controlling the conversion cycle (i.e., duty cycle) of switch 117. The conversion cycle may include the switch-on time $t_{on}$, the time switch 117 is closed, and switch-off time $t_{off}$, the time switch 117 is open. For consistent terminology in describing examples, the term "one conversion cycle," in relation to switch 117, will be used to refer to the sum of one switch-on time $t_{on}$ and its succeeding switch-off time $t_{off}$.

LED string 109*a-b* may consist of at least one diode 109*a*. Multiple LED strings may comprise an LED array. Individual LEDs 109*a*, 109*b* may be connected electrically in series or may be connected in parallel. LEDs 109*a*, 109*b* may be physically adjacent to each other in a physical array. LEDs 109*a*, 109*b* that comprise LED string 109*a-b* may produce white light, or may produce a different color. The color produced by LEDs 109*a*, 109*b* in LED string 109*a-b* may be the same or a different color. For example LED string 109*a-b* may comprise one white LED and one RGB LED (an LED containing red, green, and blue emitters). In alternative embodiments, LEDs 109*a*, 109*b* may be driven by individual current sources, with the current sources being linear current sources or current sources using alternative principles that are well known to a person of skill in the art. As will be described in greater detail in later sections, the LEDs 109*a*, 109*b* may possess differing physical characteristics. This may include, for example, differing maximum junction temperatures, luminous intensity, and color. LEDs 109*a*, 109*b* may have a characteristic forward voltage $V_f$ that is characterized by a constant voltage drop when driven by a sufficient amount of current. Resistor 111 may be connected in series with LED string 109*a-b*. Resistor 111 may receive current and may account for the difference in voltage between the output voltage $V_{out}$ and the sum of forward voltages in a series of connected LEDs 109*a*, 109*b*.

Forward voltage ($V_f$) control block 113 may sense the forward voltage of individual LEDs 109*a*, 109*b* in LED string 109*a-b*. Forward voltage control block ($V_f$) may be connected to various points of LED string 109*a-b* to measure one or more individual LEDs 109*a*, 109*b*. Forward voltage control block may comprise one or more control blocks that may be connected to various points of LED string 109*a-b* to simulate or measure a number of operating characteristics for individual LEDs 109*a*, 109*b*. Forward voltage control block 113 may measure the voltage level of resistor 111 and may therefore measure the current through LED string 109*a-b*. Forward voltage control block 113 may derive the forward voltage from the measured voltage and current. In some embodiments, forward voltage control block 113 may also measure or calculate other characteristics, such as, for example, junction temperature of LEDs 109*a*, 109*b*, or the luminous intensity. A person of ordinary skill, upon reading this disclosure, would recognize relevant components comprising forward voltage control block 113 to measure or calculate these and other physical characteristics associated with LEDs 109*a*, 109*b*.

Figure 2A:
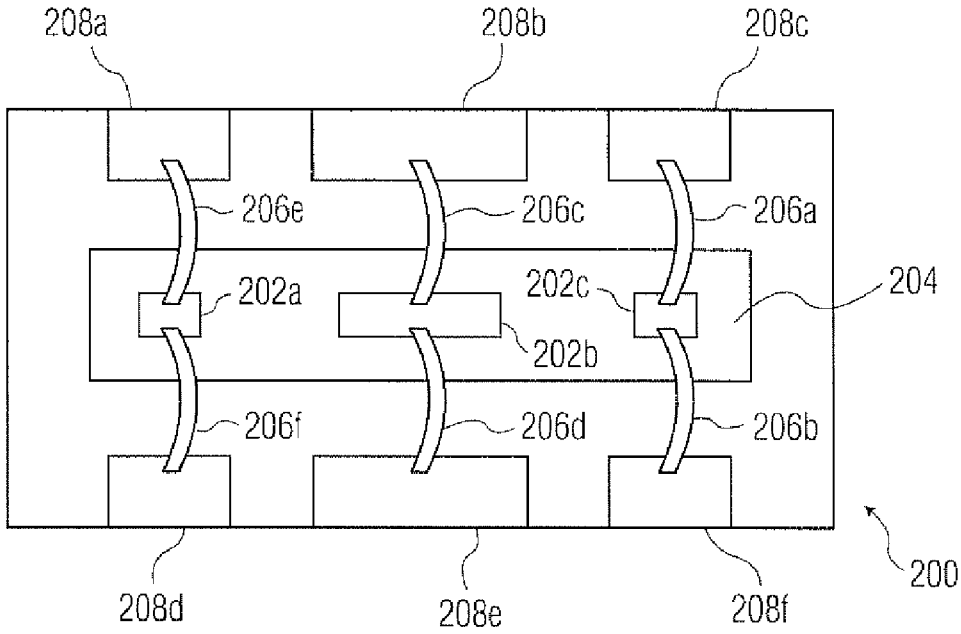
FIG. 2A is a schematic diagram of an exemplary RGB LED.

Referring now to FIG. 2A, a physical diagram of an exemplary LED package is illustrated. LED package 200 may be a package for a single LED string 109*a-b*. LED package 200 may be a cross-section of a backplate of a complete blacklight module used for the LED array. Multiple LED packages 200 may therefore join LEDs 202*a-c* to construct an LED array that may be controlled in concert to create a single image. In the illustrated embodiment, LED package 200 contains a plurality of LEDs 202*a-c*, a die paddle 204, a plurality of bond wires 206*a-f*, and a plurality of leads 208*a-f*. In the illustrated embodiment, the single transparent LED package 200 may have six electrical signals from 208*a-f* driving three individual LEDs 202*a-c* through bond wires 206*a-f*.

LEDs 202*a-c* may be individual LEDs fabricated on LED dice. In an alternative embodiment, LEDs 202*a-c* may be a single RGB LED. In another embodiment, LEDs 202*a-c* may comprise all LEDs in LED string 109*a-b*. LEDs 202*a-c* may include two pins: one for an anode (A) and one for a cathode (K). LED 202*a-c* may be forward biased when current flows from the anode pin to the cathode pin. For example when current flows from lead 208*d* through bond wire 206*f* through LED 202*a* through bond wire 206*e* through lead 208*a*, LED 202*a* may be forward biased. When forward biased, electrons in LED 202*a* may recombine with holes within LED 202*a*, which may release energy in the form of photons. The color of the photons may be determined by the energy gap of the semiconductor. For example, LED 202*a* may emit photons in the form of blue light, while LEDs 202*b*, 202*c* may emit photons in the form of green and red light, respectively. LEDs 202*a-c* may also emit white light, converted from blue or ultraviolet into a spectrum of visible light. An LCD display may use both RGB LEDs, white LEDs or a combination.

The lead frame may provide mechanical support to the dies during its assembly to a finished product. During manufacturing, the lead frame may be used to install LED die paddle 204 onto the chip. Multiple lead frames may be connected together to form the backplate of the backlight module. A lead frame may comprise die paddle 204, to which the LED dice for LEDs 202*a-c* are attached, and a plurality of leads 208*a-f*. The plurality of leads 208*a-f* may provide, through bond wires 206 *a-f*, a means for an electrical connection between the plurality of LEDs 202*a-c*, and other electrical components, such as, for example, the boost converter of FIG. 1, resistor 111, and forward voltage control block 113. In the illustrative embodiment, LEDs 202*a-c* share common die paddle 204, while remaining electrically independent. As will be discussed in greater detail in later sections, because LEDs 202*a-c* share common die paddle 204, they are thermally dependent on one another and share a common heat sink.

Figure 2B:
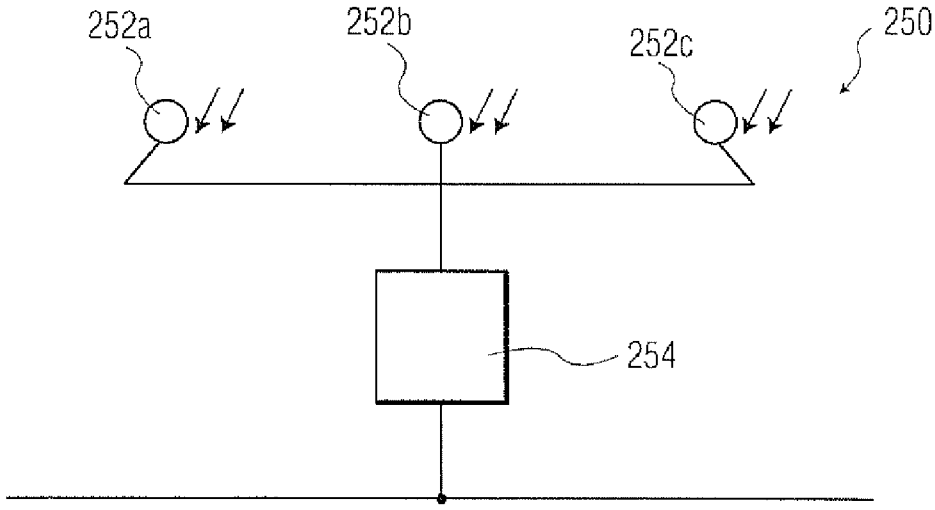
FIG. 2B is a functional block of an exemplary RGB LED using a thermal model.

Referring now to FIG. 2B, a block diagram of a thermal model of an LED string is illustrated. Similar in composition to LED package 200 of FIG. 2A, in the illustrative embodiment, LED string 250 contains a plurality of LEDs 252*a-c* and a lead frame 254 with a thermal conducting path to the ambient environment. In other embodiments, lead frame 254 may be connected in series or in parallel with other lead frames before connecting to the ambient environment. In the illustrative embodiment, LEDs 252 *a-c* are not thermally isolated; rather, LEDs 252*a-c* share a common die paddle and a common lead frame 254. However, LEDs 252*a-c*, as shown in for LED package 200 in FIG. 2, may still be electrically isolated due to the isolated leads 208*a-f*. As LEDs 252*a-c* share a common lead frame (and heat sink) 204, the thermal resistivity for LEDs 252*a-c* lowers, with LEDs 252*a-c* sharing a common "pool" of thermal junction temperatures. The maximum thermal resistance of the heat sink to an ambient temperature may be defined as:

$$R_{hs} = \frac{\Delta T}{P_{th}} - R_s$$

Where $R_{hs}$ is the thermal resistance of the heat sink to ambient, $\Delta T$ is the temperature difference, $P_{th}$ is the generated thermal power, and $R_s$ is the thermal resistance of the LED die. Accordingly, when combining multiple dice on a shared heatsink, the resistivity of the individual heatsinks is put in parallel.

LEDs 252*a-c* may be thermally dependent. Mores specifically, the maximum allowed junction temperatures of LEDs 252 *a-c* may be inversely proportional. As a result, when one LED 252*a* dims below its nominal luminance, which may be defined as its luminance when operating at its maximum isolated junction temperature, other connected LEDs 252*b-c* may therefore be driven beyond their respective nominal luminous intensities due to excess available conductivity in common lead frame 254. In an alternative embodiment, a common thermal conducting plate may be used as the backplate of the backlight module to thermally connect all the individual LEDs in an LED array.

Common lead frame 254 may therefore enable higher brightness, which is maximum luminance, and higher contrast, which is related to the range of luminous outputs, for a given power level. As will be discussed in greater detail in a later section, using a controlled current per LED string 109*a-b*, a maximum performance for an LED array may be achieved, while stabilizing luminance for uniformity.

Figure 3:
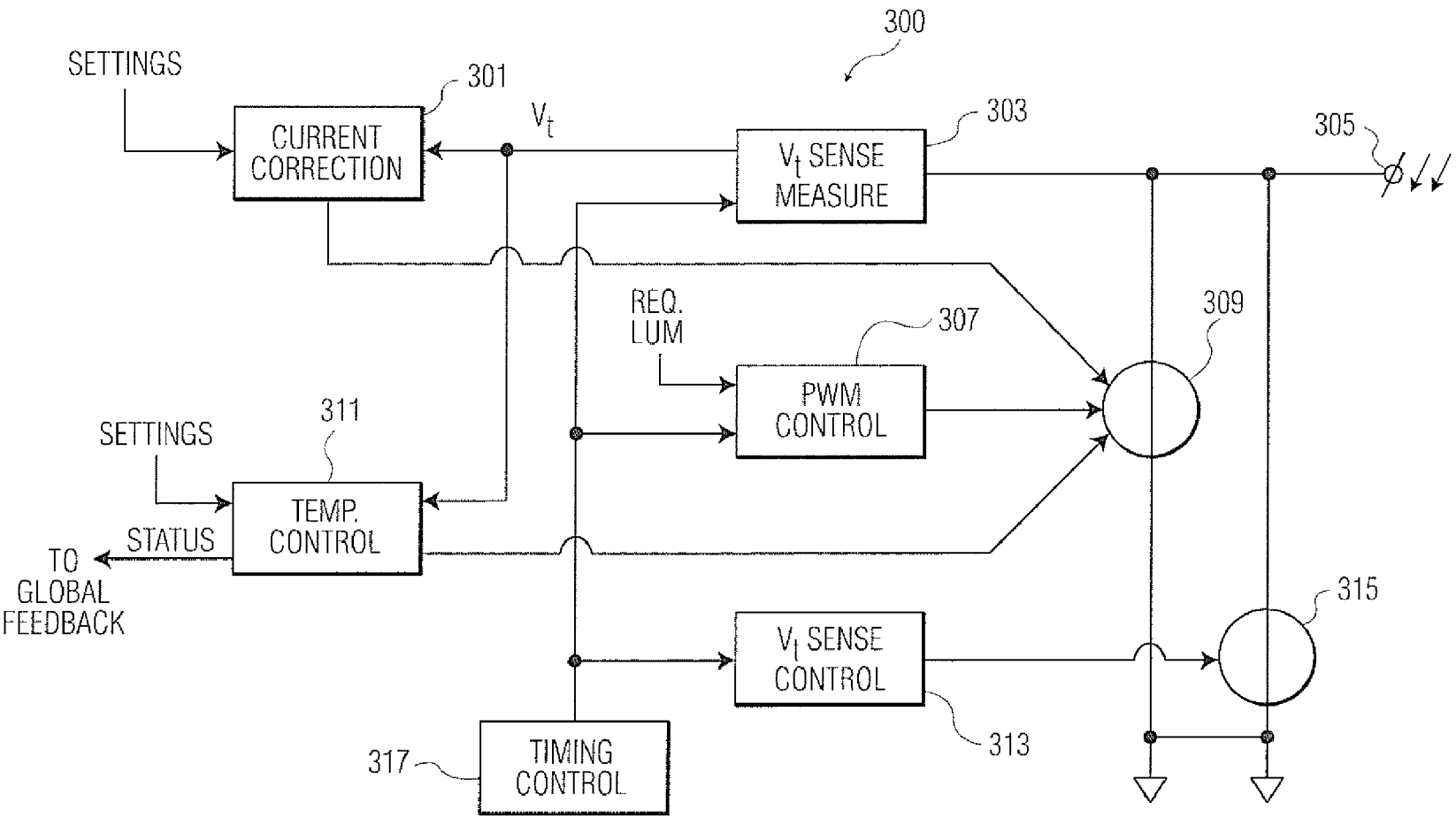
FIG. 3 is a functional block of an exemplary bit LED circuit with components of an LED driver circuit.

Referring now to FIG. 3, a functional block of an exemplary LED driver circuit is illustrated. LED driver 300 may similar in composition to LED driver 100 in FIG. 1. In the illustrated embodiment, LED driver 300 contains a current correction controller 301, a forward voltage sense measuring controller 303, an LED 305, a pulse-width modulation (PWM) controller 307, a regular current source 309, a temperature controller 311, a forward voltage sense controller 313, a sense current source 315, and a timing controller 317.

During regular operation, LED driver 300 may receive a requested luminance. PWM controller 307 may receiving a timing signal from timing controller 317 and may produce a pulse-width modulation (PWM) current to LED 305. In the illustrated embodiment, the regular current that may be delivered during the active period (i.e., switch-on time) is depicted as regular current source 309. This regular current may drive LED 305, which exhibits both a forward voltage and outputs the requested luminance. The value of regular current source may be of a sufficient value to place LED 305 in forward bias.

During the inactive portion of the duty cycle (i.e., switch-off time), timing controller 317, through forward voltage sense controller 313, may drive a sense current, illustrated as sense current source 315 towards LED 305. The sense current may be received by LED 305, but may not high enough to produce any output luminance by LED 305. During this time, timing controller may cause forward voltage sense measuring controller ($V_f$-SMC) 303 to measure the forward voltage of LED 305. $V_f$-SMC 303 may measure the forward voltage and send the sensed forward voltage to both current correction controller 301 and temperature controller 311.

Current correction controller 301 may drive an altered forward current based on the measured forward voltage received from $V_f$-SMC 303. Current controller 301 may either limit or boost regular current source 309 through amplitude modulation instead of controlling PWM controller 307. Current controller 301 may also modulate regular current source 309 based on settings received from outside sources, such as a global controller, which may be a processing unit, such as a display processing unit, or other LED drivers.

Temperature controller 311 may also drive an altered forward current based on the measured forward voltage received from $V_f$-SMC 303. Temperature controller 311 may, for example, calculate the junction temperature of LED 305 based on the linear relationship between the junction temperature and the forward voltage. Temperature controller 311 may either limit or boost regular current source 309 through amplitude modulation instead of controlling PWM controller 307. Temperature controller 311 may modulate regular current source 309 based on settings received from outside sources, such as a global controller or other LED drivers.

Temperature controller 311 may also forward the status of the LED to a global controller or other LED drivers. The global controller may take an appropriate action. This may include no action, which may result luminance limitation artifacts. The global controller may also drive extra luminance from adjacent LEDs to guarantee the requested luminance; this may result in halo artifacts. The global controller may also drive extra luminance from video-data (i.e., gain) to guarantee the requested luminance; this may result in clipping artifacts in the video-data.

Timing controller may calibrate LED driver 300 at an initial time $t_0$. During this initial time, the luminance and color of LED 305 may be of a sufficient luminance, color, and uniformity. After initial time $t_0$, the measured forward voltage may vary, due to, for example, temperature variations. Current correction controller 301 may then correct the regular current delivered to LED 305. This may be to drive LED 305 below a maximum allowed temperature. This may also be to maintain the calibrated initial luminance or to maintain uniformity.

LED driver 300 therefore allows for adaptive global brightness based on temporal dimming, adaptive local brightness based on spatial dimming, and adaptive brightness based on the ambient temperature. There may be more performance from the LED driver, as cooler systems automatically enable more brightness. There may also be better adaptive brightness with power-efficient LEDs, as there may be more local brightness due to their use.

Figure 4:
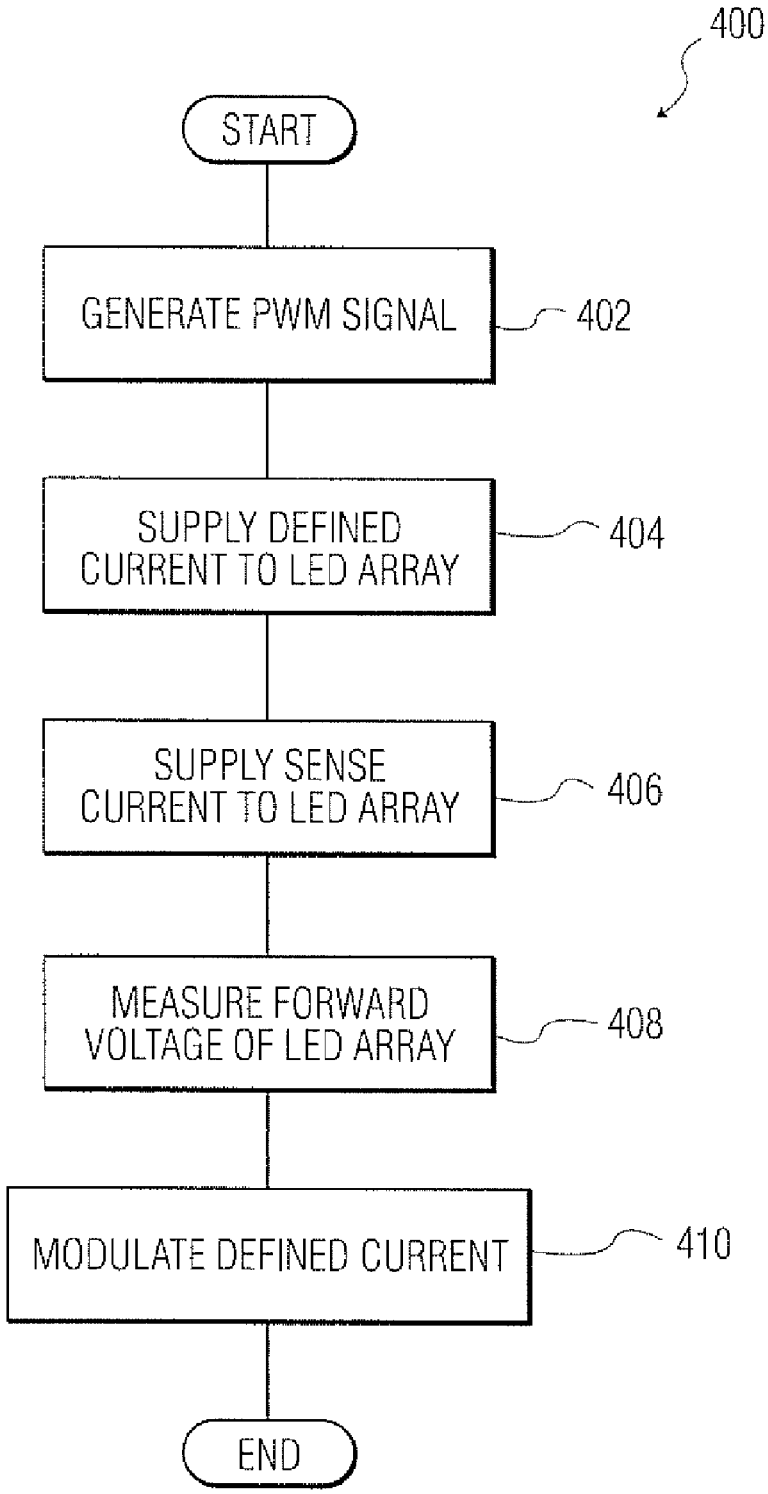
FIG. 4 is flowchart of an exemplary method of driving an LED array.

FIG. 4 is one illustrative example of applying one method practiced in, for example, the FIG. 3 system, of driving an LED array based on a requested luminance and maximum operating junction temperature. Method 400 may drive a single LED 109*a* or may drive an LED string 109*a-b*. LED string 109*a-b* may be calibrated to produce an initial luminance or uniformity, which may change during regular operation.

Beginning with step 402, a pulse-width modulated (PWM) signal is generated by, for example, PWM controller 307. The PWM may be adjusted based on, for example, a requested luminance received by PWM controller 307. The timing of delivery of the PWM may be controlled by, for example, timing controller 317.

In step 404, a regular current may be supplied to LED string 109*a-b*. This may occur during the active period (i.e., switch-on time) of the duty cycle of the PWM signal. The LEDs 109*a*, 109*b* in LED string 109*a-b* may produce a luminance based on the regular current received. During regular operation, this current may match the requested luminance received by PWM controller 307. An individual LED 109*a* may deliver a luminance higher than their isolated nominal luminance, which may be defined as the maximum luminance produced when operating at a maximum junction temperature when the individual LED 109*a* is thermally isolated from other LED devices. Because LED 109*a* shares a lead frame 254 with other LEDs 109*b*, LED 109*a* may produce a higher luminance without reaching the maximum shared junction temperature of LED string 109*a-b*.

In step 406, a sense current may be supplied to the LED 109*a*. This may occur during the inactive period (i.e., switch-off time) of the duty cycle of the PWM signal. The sense current may be driven by forward voltage sense controller 313 to LED 109*a*. The sense current may be too small to produce any luminance by the LED 109*a*.

In step 408, the forward voltage of LED 109*a* may be measured by, for example, forward voltage sense measuring controller ($V_f$-SMC) 303. $V_f$-SMC 303 may forward the measured forward voltage to other controllers, such as, for example, current correction controller 301 and temperature controller 311.

In step 410, the regular current may be modulated. This may include PWM controller 307 modulating the duty cycle of the PWM signal to change the regular current delivered during the active period. This may also comprise either current correction controller 301 or temperature controller 311 modulating the amplitude of the regular current. This may result in either dimming or boosting the luminance produced by the LED.

Although the various exemplary embodiments have been described in detail with particular reference to certain exemplary aspects thereof, it should be understood that the invention is capable of other embodiments and its details are capable of modifications in various obvious respects. As is readily apparent to those skilled in the art, variations and modifications may be implemented while remaining within the spirit and scope of the invention. Accordingly, the foregoing disclosure, description, and figures are for illustrative purposes only and do not in any way limit the invention, which is defined only by the claims.

What is claimed is:

1. A circuit to deliver current from a current source to a light-emitting diode (LED) string, the circuit comprising:

a pulse width modulator controller for generating a pulse-width modulated (PWM) drive signal having a duty cycle and driving the LED string with a regular current during an active period of the PWM drive signal;

a forward voltage sense controller for driving a sense current, the sense current being driven into the LED string during an inactive period of the duty cycle of the PWM drive signal;

a forward voltage sense measuring controller for measuring a forward voltage in the LED string created by the sense current and for outputting the forward voltage;

a temperature controller for receiving the forward voltage from the forward voltage sense measuring controller and controlling the regular current, so that the LED string operates at a junction temperature below a maximum allowed operational junction temperature; and a current correction controller for receiving the forward voltage from the forward voltage sense measuring controller and controlling the regular current, wherein the flux of an LED in the LED string is stabilized by driving the LED with a constant power.

2. The circuit of claim 1, further comprising:

a timing controller for controlling outputs of the PWM controller, forward voltage sense controller, and forward voltage sense measure controller with a timing signal.

3. The circuit of claim 2, wherein the timing controller produces an initial time, wherein the LED string produces an initial luminance.

4. The circuit of claim 1, wherein the PWM controller generates a PWM signal in response to a requested luminance.

5. The circuit of claim 1, wherein the temperature controller generates an alarm signal when at least either the junction temperature of at least one LED is above the maximum allowed operational temperature or the LED string cannot produce the requested luminance.

6. The circuit of claim 1, wherein the LED string comprises at least a red diode, green diode, and blue diode connected electrically in parallel and wherein the red diode, green diode, and blue diode share a lead frame.

7. The circuit of claim 1, wherein the LEDs in the LED string share a thermal conducting plate.

8. A system for supplying power for a light-emitting diode (LED) string, the system comprising:

a first circuit to deliver current from a current source to the LED string, the first circuit comprising:

a pulse width modulator controller for generating a pulse width modulated (PWM) drive signal and driving the LED string with a regular current during an active period of the PWM driver signal;

a forward voltage sense controller for driving a sense current, the sense current being driven into the LED string during an inactive period of the duty cycle of the PWM drive signal;

a forward voltage sense measuring controller for measuring a first forward voltage in the LED string created by the sense current and for outputting the first forward voltage;

a temperature controller for:

receiving the first forward voltage from the first forward voltage sense measuring controller and controlling the regular current, wherein the LED string operates below a maximum allowed operational junction temperature, and generating an alarm signal when at least either a junction temperature of at least one LED is above the maximum allowed operational temperature of the LED or the LED string cannot produce a first requested luminance; and a current correction controller for receiving the first forward voltage from the forward voltage sense measuring controller and controlling the regular current, wherein the flux of the LED in the LED string is stabilized by driving the LED with a constant power; and a second circuit to deliver current from a second current source to a second LED string in response to the alarm signal received from the first circuit.

9. The system of claim 8, wherein the second circuit modulates a second regular current, wherein the second regular current generates a luminance in the second LED string that is equal to the sum of a second requested luminance and the difference of the first requested luminance and the luminance produced by the first LED string.

10. The system of claim 8, wherein the LED string comprises at least a red diode, green diode, and blue diode connected electrically in parallel and wherein the red diode, green diode, and blue diode share a lead frame.

11. A method for supplying power for a light-emitting diode (LED) string, the method comprising:

generating a pulse width modulated (PWM) drive signal;

supplying the LED string with a regular current in response to the PWM drive signal having a duty cycle, the regular current being supplied during an active period of the duty cycle of the PWM drive signal;

supplying the LED string with a sense current during an inactive period of the duty cycle of the PWM drive signal;

measuring a forward voltage of the LED string during the inactive period of the duty cycle; and modulating the regular current in response to the measured forward voltage, wherein the flux of an LED in the LED string is stabilized by driving the LED with a constant power and the LED string operates below a maximum allowed operational junction temperature.

12. The method of claim 11, wherein the PWM drive signal is based on a feedback signal calibrated at an initial time.

13. The method of claim 11, wherein the generating step is in response to a requested luminance.

14. The method of claim 11, further comprising:

generating an alarm signal when at least either a junction temperature of at least one LED is above its maximum allowed operational temperature of the LED or the LED string cannot produce the requested luminance.

15. The method of claim 11, wherein the LED string comprises at least a red diode, green diode, and blue diode connected electrically in parallel and wherein the red diode, green diode, and blue diode share a lead frame.

16. The method of claim 14, further comprising:

supplying a second LED string with a second regular current in response to the alarm signal.

17. The method of 16, further comprising:

modulating the second regular current, wherein the second regular current generates a luminance in the second LED string that is equal to the sum of a second requested luminance and the difference of the first requested luminance and the luminance produced by the first LED string.

18. The method of claim 11, further comprising:

generating an alarm signal when a junction temperature of at least one LED is above the maximum allowed operational temperature of the LED.

19. The method of claim 18, further comprising:

supplying a second LED string with a second signal in response to a received alarm signal.

20. The method of 19, further comprising:

modulating the second regular current, wherein the second regular current generates a luminance in the second LED string that is equal to the sum of a second requested luminance and the difference of the first requested luminance and the luminance produced by the first LED string.

* * * * *